US005856726A

United States Patent [19]

Evans et al.

[11] Patent Number: 5,856,726

[45] **Date of Patent: *Jan. 5, 1999**

[54] ELECTRIC LAMP WITH A THREADED ELECTRODE

[75] Inventors: Jean M. Evans, North Hampton; Harold L. Rothwell, Jr., Hopkinton, both of N.H.

[73] Assignee: Osram Sylvania Inc., Danvers, Mass.

[ * ] Notice: The terminal 5 months of this patent has been disclaimed.

[21] Appl. No.: 616,394

[22] Filed: Mar. 15, 1996

[51] Int. Cl.[6] ..... H01J 1/00; H01J 61/04

[52] U.S. Cl. ..... 313/491; 313/356; 313/631

[58] Field of Search ..... 313/352, 356, 313/491, 492, 631, 632, 633

[56] References Cited

U.S. PATENT DOCUMENTS

| | | | |
|---|---|---|---|
| 1,842,215 | 1/1932 | Thomas . | |
| 1,890,926 | 12/1932 | Anderson, Jr. et al. | 313/352 |
| 1,891,074 | 12/1932 | Winter, Jr. | 313/356 |
| 2,061,390 | 11/1936 | Stevens | 313/352 X |
| 2,310,983 | 2/1943 | Miller | 313/631 X |
| 2,429,118 | 10/1947 | Resser | 313/492 X |
| 2,449,113 | 9/1948 | Fruth | 313/633 X |
| 2,812,465 | 11/1957 | Germeshausen . | |
| 2,847,605 | 8/1958 | Byer . | |
| 2,888,592 | 5/1959 | Lafferty | 313/356 |
| 3,444,415 | 5/1969 | Skirvin | 313/491 |
| 3,505,553 | 4/1970 | Piree . | |
| 3,560,790 | 2/1971 | Vollmer . | |
| 3,875,629 | 4/1975 | Kerstetter . | |
| 3,879,830 | 4/1975 | Buescher . | |
| 3,883,764 | 5/1975 | Johnson et al. | 313/356 X |
| 3,906,271 | 9/1975 | Aptt | 313/491 |
| 3,969,279 | 7/1976 | Kern . | |
| 4,461,970 | 7/1984 | Anderson . | |
| 4,533,852 | 8/1985 | Frank . | |
| 5,214,351 | 5/1993 | Nieda | 313/619 |
| 5,278,474 | 1/1994 | Nieda | 313/631 |
| 5,304,893 | 4/1994 | Nieda | 313/631 |

*Primary Examiner*—Hezron E. Williams
*Assistant Examiner*—Daniel S. Larkin
*Attorney, Agent, or Firm*—William E. Meyer

[57] ABSTRACT

An electric discharge lamp with an internally threaded electrode is disclosed. The lamp includes an envelope, a support rod, and an electrode can with an interior surface having a multiplicity of peaks, points, of sharp edge regions. These equal height prominences evenly extended around the inside wall of the electrode can. The threaded electrode yields a highly emissive electrode with no emissive material to be eroded.

24 Claims, 6 Drawing Sheets

ELECTRIC LAMP WITH A THREADED ELECTRODE

1. Technical Field

The invention relates to electric lamps and particularly to discharge type electric lamps. More particularly the invention is concerned with an electric discharge lamp with a threaded electrode.

2. Background Art

Rare gas discharge lamp electrodes are commonly made by first dipping a wire, or coil in a slurry of emissive material and a carrier medium or solvent. The emissive material is then baked to drive off the carrier fluid. In a lamp, the discharge then emanates from the baked on emissive material. As the wire and emissive material heat up, material may sputter from the electrode, and thereafter deposit on the lamp walls. Sputtered material darkens the lamp, and ultimately reduces the emissivity of the electrode. To contain the sputtering, the emissive electrode may be enclosed in a can. Sputtered material is then partially trapped in the electrode can where it tends to redeposit on the electrode can wall.

For a lamp to provide rapid light output, the electrode should have a minimal mass to heat quickly. Dipping and spray coating may over coat the electrode, and can leave a heavy coating of emissive material whose mass takes longer to heat to a full on condition. The least possible coating is then best for rapid start up. However, for longevity, the electrode should be massive. Balancing electrode responsiveness with long life requires care. There is then a need for an electrode that functions like an emissive electrode with minimal or no emissive coating material. For lamps produced in great quantity, cost and time of manufacture are important. There is then an additional need to create an inexpensive electrode that requires minimal processing that still has long life.

Neon lamps are known to produce red light, and therefore offer the opportunity of an unfiltered vehicle stop lamp. Typical neon sign lamps are long tubes about one or two centimeters in diameter, that contains the diffused gaseous neon plasma light source. These lamps typically have inputs of 1100 to 1200 volts, at a few milliamps of power. For optical reasons, it is convenient to have a narrow, stabily positioned arc. A narrow arc causes high electron impact where the arc attaches to the electrode, leading to an erosion of electrode material. Once the high emissive coating is eroded, the arc may shift location, spread, or jitter, all of which are optically undesirable. There is then a need for a small diameter lamp, with a durably positioned arc.

Neon sign lamps have large electrodes at each end that provide great durability. The large electrodes also amounts to a large darkened length at each end of the lamp tube. The darkened lamp ends frustrate vehicle designers trying to provide an even lighting across the lamp face. Vehicles need compact reflectors and lenses for reduced wind resistance, reduced vehicle cost, and enhanced styling flexibility. There is then a need for a small diameter neon lamp that produces a large number of lumens, without forming an elongated dark spot at each end.

Some vehicle stop lamps are expected to provide from 100,000 to 800,000 lamp starts within an operating life span of 2000 hours. Common neon lamps can provide such service, but only by making the electrode large, resulting in a diffused light source, and a large dark spot. Making conventional electrodes small has resulted in lamps that sputter the electrode, resulting in a short lamp life. The sputtering degrades the lamp interior, thereby darkening the lamp and reducing lamp performance. In either case the result for vehicles would be unacceptable. There is then a need to produce a small diameter neon lamp that can provide long life service in a vehicle, without failing, and not substantially changing color, intensity, or performance. Further there is a need to produce a neon lamp electrode that is small and does not degrade appreciably over the expected life of the lamp.

Examples of the prior art are shown in U.S. patents:

U.S. Pat. No. 1,842,215 issued to C. Thomas on Jan. 19, 1932 for Electrode for Gaseous Discharge Devices shows a metal can coated on the inside with barium oxide.

U.S. Pat. No. 2,123,709 issued to L. J. Bristow et al on Jul. 12, 1938 for a Therapeutic Light Ray Apparatus shows narrow, folded over neon tube for therapeutically probing body cavities.

U.S. Pat. No. 2,812,465 issued to K. J. Germeshausen on Nov. 5, 1957 for a Gaseous Discharge Device shows an a xenon discharge lamp using a hollow cathode. In FIG. 4 the electrode is shown as surrounded by an open ended cylinder supported at one end by a wire mesh. The electrode can and wire mesh structure are to capture sputtered material.

U.S. Pat. No. 2,847,605 issued to A. A. Byer on Aug. 12, 1958 for a Electrode for Fluorescent Lamps shows a fluorescent lamp with a hollow cathode electrode. The inside of the cathode is described as having a sloping emitter material leading to a greatest thickness at the rim of the cup. The coating is described as being formed by spraying or dipping.

U.S. Pat. No. 3,505,553 issued to P. T. J. Piree on Apr. 7, 1970 for a Radio Interference Free Low Pressure Mercury Vapor Lamp shows an emitter material with a boron component useful in suppressing radio interference emissions. The emitter is coated on the inside wall of a can type electrode. No particular coating method is described.

U.S. Pat. No. 3,560,790 issued to John Vollmer on Feb. 2, 1971 for Alkali Cathode Lamps shows a metal can electrode with a alkali metal coating.

U.S. Pat. No. 3,879,830 issued to William E. Buescher on Apr. 29, 1975 for Cathode for Electron Discharge Device Having Highly Adherent Emissive Coating of Nickel and Nickel Coated Carbonates shows an emissive coating sprayed on the electrode and baked in place. The coating material is ground to a fineness sufficient to allow liquid spraying.

U.S. Pat. No. 3,906,271 issued to Harry W. Aptt Jr. on Sep. 16, 1975 for a Ceramic Cup Electrode for a Gas Discharge Device shows an a xenon discharge lamp using a hollow cathode. An emissive powder is pressed and sintered in the cup to anchor the material in place.

U.S. Pat. No. 3,969,279 issued to Edmond R. Kern on Jul. 13, 1976 for Method of Treating Electron Emissive Cathodes shows a method of heat treating the emissive material on an electrode to eliminate excessive barium.

U.S. Pat. No. 4,461,970 issued to John M. Anderson on Jul. 24, 1984 for a Shielded Hollow Cathode Electrode for Fluorescent Lamp shows several hollow cans concentrically positioned one inside another. The electrode coating is described as being conventional.

U.S. Pat. No. 4,533,852 issued to Berthold Frank et al on Aug. 6, 1985 for a Method of Manufacturing a Thermionic Cathode and Thermionic Cathode Manufactured by Means of Said Method shows a hot cathode type electrode with a can coated internally by chemical vapor deposition.

U.S. Pat. No. 4,695,152 issued to Charles Urso for Charge Erase Device for an Electrophotographic Printing Machine on Sep. 22, 1987 Urso discloses a photocopier machine using a neon lamp. Prior photocopier lamps were mercury or other types. The neon lamp used is a 10 mm diameter lamp with 9 to 25 torr of pure neon operated at 10 to 50 mA (rms) (35 mA preferred). The lamp is found to have rapid start and long life, and most importantly adequately affects the surface charging in a photocopier.

U.S. Pat. No. 5,278,474 issued to Yoriyuki Nieda on Jan. 11, 1994 for Discharge tube shows a sintered metallic electrode.

DISCLOSURE OF THE INVENTION

An electric lamp may be formed with a light transmissive envelope defining an enclosed volume, a first input lead sealed to and extending through the envelope with an interior end of the first lead located in the enclosed volume, an electrode can attached to the interior end of the lead. The electrode can has a wall with an interior side defining an interior can cavity, and defining an opening of the can cavity at an end of the can away from the lead. The interior side has at least one edge extended radially inward, forming an interior edge around at least a portion of the defined opening. A second input lead may be sealed to and extend through the envelope with an interior end of the second lead located in the enclosed volume, a second electrode coupled to the interior end of the second lead. The lamp may include a fill material enclosed in the enclosed volume excitable to light emission by the application of sufficient electric voltage and current between the first electrode and the second electrode.

BEST MODE FOR CARRYING OUT THE INVENTION

Figure 1:
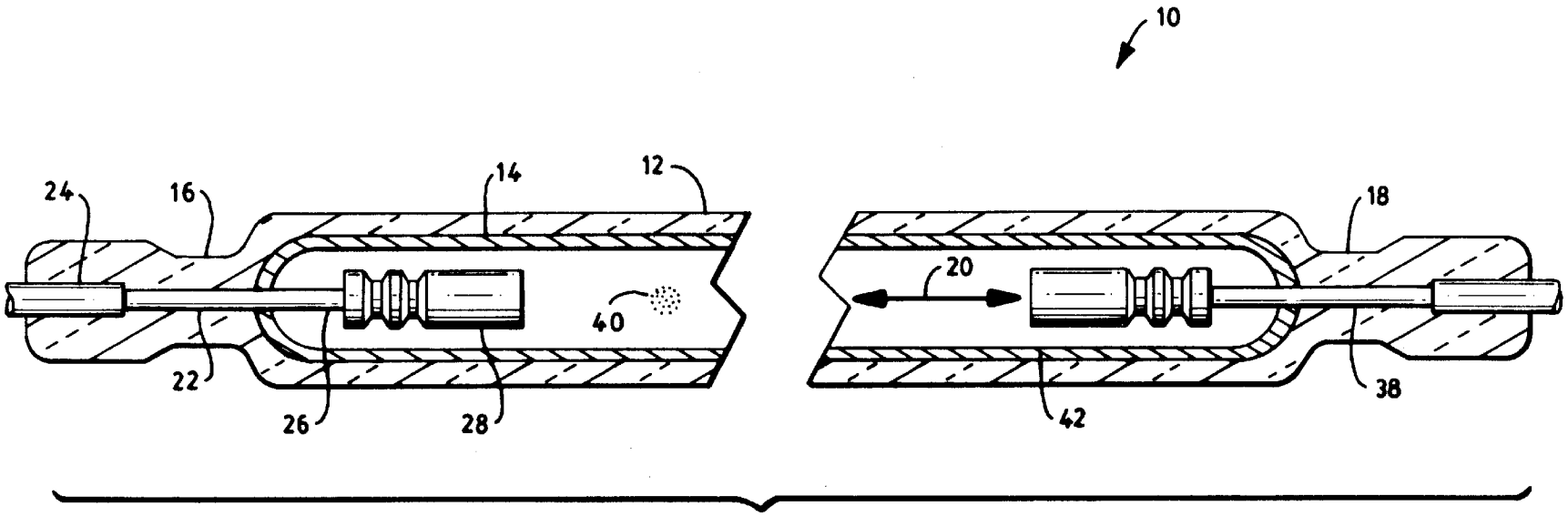
FIG. 1 shows a cross sectional view of a preferred embodiment of an electric lamp with a threaded electrode.

FIG. 1 shows a preferred embodiment of an electric lamp 10 with a threaded electrode. Like reference numbers designate like or corresponding parts throughout the drawings and specification. The electric lamp 10 with threaded electrode may be assembled from an envelope 12, a first input lead 22, an electrode can 28, with an internal surface 36, a similar second electrode structure 38, a fill material 40, and an optional fluorescent coating 42.

The envelope 12 may be made out of light transmissive material, such as glass, quartz, sapphire or alumina. The preferred envelope 12 is made from an aluminasilicate glass. The envelope 12 may have the general form of a tube with an internal wall 14 defining an enclosed volume, and having sealed ends 16, and 18. The variety of shapes of lamp envelopes that may be used in discharge lamps is rather large. Generally they are categorized as single ended or double ended lamps. There is nothing to prohibit the use of the disclosed electrode structure in the various forms of discharge lamps, and it is anticipated that variations and adaptations will make the present electrode structure generally useful in discharge lamps in general. The preferred lamp 10 is a double ended, press sealed lamp, in the general form of a tube with a central axis 20. The lamp envelope 12 at one end has at least one seal region 16. The seal region 16 for a glass or quartz envelope may be press sealed, or vacuum sealed. For other envelope materials, such as sapphire or polycrystalline alumina (PCA), other seal structures may be necessary as are known in the art. The preferred seal region 16 is a press seal made in the aluminasilicate glass.

The first input lead 22 may be made out of conductive metal such as tungsten, tantalum, molybdenum, nickel, iron, or various alloys thereof to have the general form of a rod, or two rods with an intermediate sealing foil. Such lead structures are generally known in the art, and the particular seal used is felt to be a matter of design choice. In the preferred embodiment, the envelope 12 seals to the first input lead 22, which has a first end 24 extending from the exterior through the seal region 16 and continues to a second end 26 extending into the enclosed volume. The preferred first end 24 is a straight rod of molybdenum. In the preferred embodiment, the second end 26 is normally, approximately co-linearly aligned with the lamp axis 20 to thereby centrally locate the electrode can 28. Normally, a lamp's discharge arc is preferably formed centrally along the lamp axis to be equidistant from the lamp envelope wall. Gravity and thermal convection are known to affect the shape of the arc, and displacement from the axis, and arc tube bending are known lamp variations to accommodate these arc shape changes.

Figure 2:
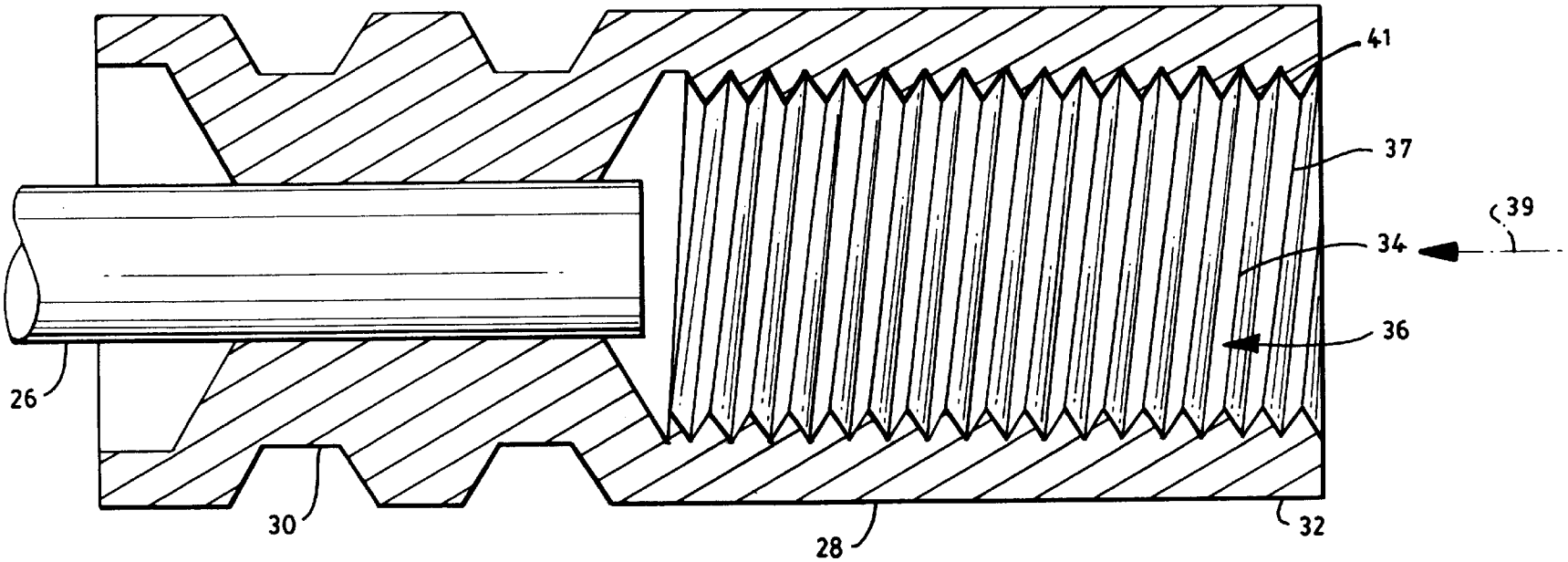
FIG. 2 shows a cross sectional view of the preferred threaded electrode.

FIG. 2 shows a cross sectional view of a threaded electrode. The electrode can 28 may be made out of electrically conductive high temperature material such as tungsten, tantalum, titanium, vanadium, molybdenum, nickel, niobium, iron, or others and alloys thereof as are generally known in the art of electrodes. The preferred electrode can 28 has the general form of a cylinder with at least one open end. The envelope 12 then encloses the electrode can 28 in the defined volume. The first input lead 22 mechanically supports and electrically couples to the electrode can 28. The first input lead 22 then holds the electrode can 28 in the enclosed volume, and provides the electrical connection to the electrode can 28 from the exterior.

The electrode can 28 has a first can end 30, a second can end 32, and an internal can wall 34 defining an interior can volume 36. The first input lead 22 may be electrically and mechanically coupled to the first can end 30. The coupling may be any convenient coupling method. The second can end 32 is generally open to expose the internal can wall 34 and the interior can volume 36 in the axial direction of the lamp. The can is then generally open from the second can end 32 to the first can end 30 exposing the interior can wall 34. The first input lead 22 end is mechanically coupled to the first end 24. The coupling may be any convenient mechanical coupling. The preferred material is tantalum. The preferred electrode can is formed from a metal tube with an inside diameter sufficient to receive the second lead end 26. The second input lead end 26 may then be inserted into the first end 30 of the electrode can 28. The electrode can 28 in the region of the first can end 30 may then be crimped, welded or otherwise joined to the second input lead end 26 to mechanically and electrically couple the two together. In the preferred embodiment, the second lead end 26 is inserted into the first can end 30 just enough to over lap the two pieces for a secure crimped coupling to be formed. In the preferred embodiment, the second lead end 26 then does not extend into the interior can volume 36, and thereby does not interfere with the internal can volume from acting as a cylindrical hollow cathode.

Inside the electrode can 28 is a can wall 34 defining an interior can volume 36. The preferred can wall 34 has a surface with a multiplicity of sharp pointed protuberances, or edges 37 around a can axis 39. If the protuberances are an even albeit random distribution of peaks, it has been found that one peak or several peaks still predominate in attracting the arc, and thereby skew the arc placement. It has been found that by forming an azmuthially continuous, an even, sharp edged, ridge such as in a ring(s), or threading(s), around the inside of the electrode can 28, the arc is equally attracted around the interior wall 36. The arc is then stabily, centered in the electrode can 28. It is believed that stabilizing, and centralizing the arc enhances the hollow cathode function of the electrode can. It has also been found that the internal sharp ridge function operates better when located at, or near the near the front edge of the can opening. It has been found that when the sharp edge ridge is located deeply in the can, perhaps more than a quarter of the depth of the can, the arc may wander from the inside of the can, and envelope the outside of the can. When the arc envelopes the outside of the can, the lamp performance is ordinary.

It is also believed that the ridge works best when it has a sharp protruding edge, like a knife or similar edge, forming a corner with the vertex 41 facing into the can volume, towards the can axis 39. The preferred interior can wall 34, for reasons of improved starting, performance and manufacturing simplicity, has a threaded inside wall. The thread provides a long sharp edge, or protuberance. The use of ductile metals allows a fine, sharp thread, while the use of less easily machined metals allows a cracked, craggy or otherwise sharply irregular surface. In each instance, the plurality of sharp points, or long sharp edge enables points for high electron concentration. The circularly aligned discharge edge provides a nearly continuous series of emission points. The high electron emission points for high electron concentration are believed to allow electrons to be easily discharged from the electrode can 28. The helical alignment allows the arc to attach to the front entrance of the can, and then follow (walk) the thread edge deeper into the can cavity. In a sense, the arc threads onto the electrode, and stabily and accurately positions itself there.

The circular alignment allows an even supply of electrons (radially constant) into the hollow cathode region defined by the internal can wall. The result is an efficient electrode operating with little or no spacial irregularity.

Figure 3:
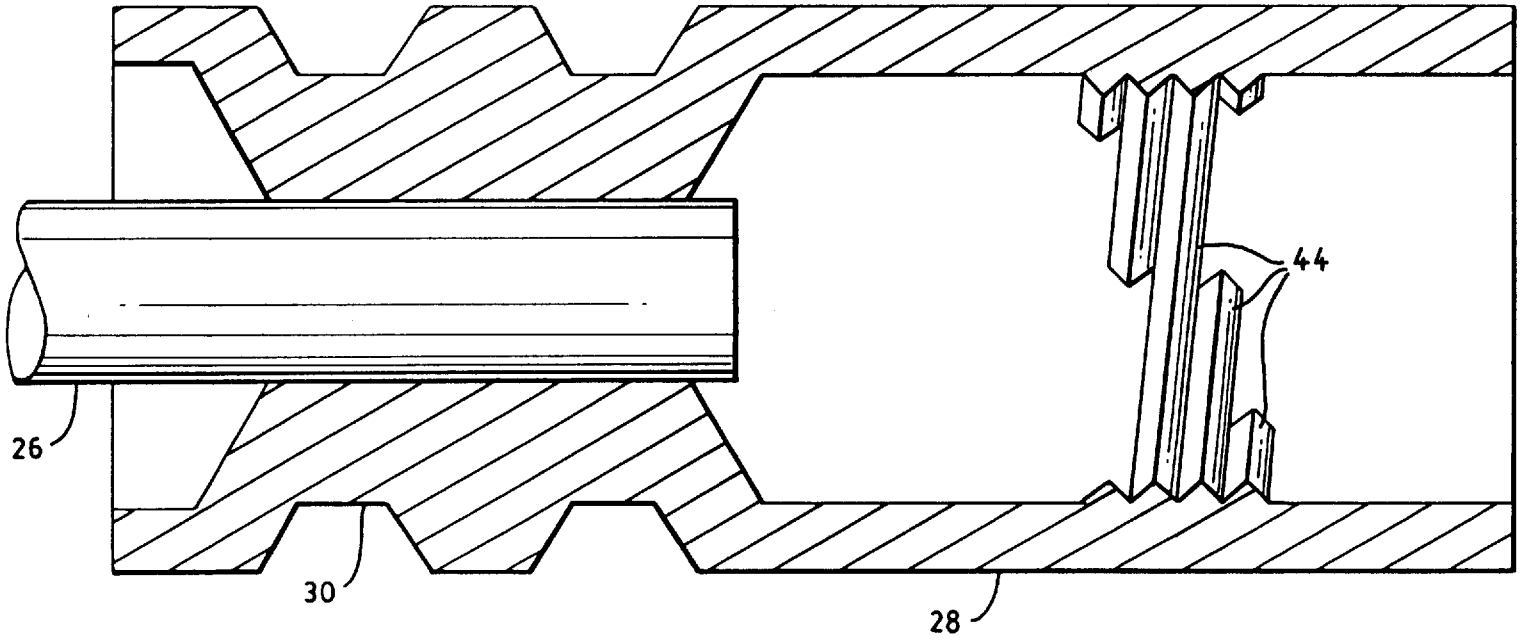
FIG. 3 shows a cross sectional view of an alternative embodiment of a multi-threaded electrode.

FIG. 3 shows a cross sectional view of an alternative embodiment of a multithread electrode. The threading need not be limited to a single thread. Multiple threads 44 may be used. In this case, a single threading need not extend around the whole interior of the electrode can 28. The several threads may form overlapping spirals, that as a group ring the inside of the electrode can 28.

Figure 4:
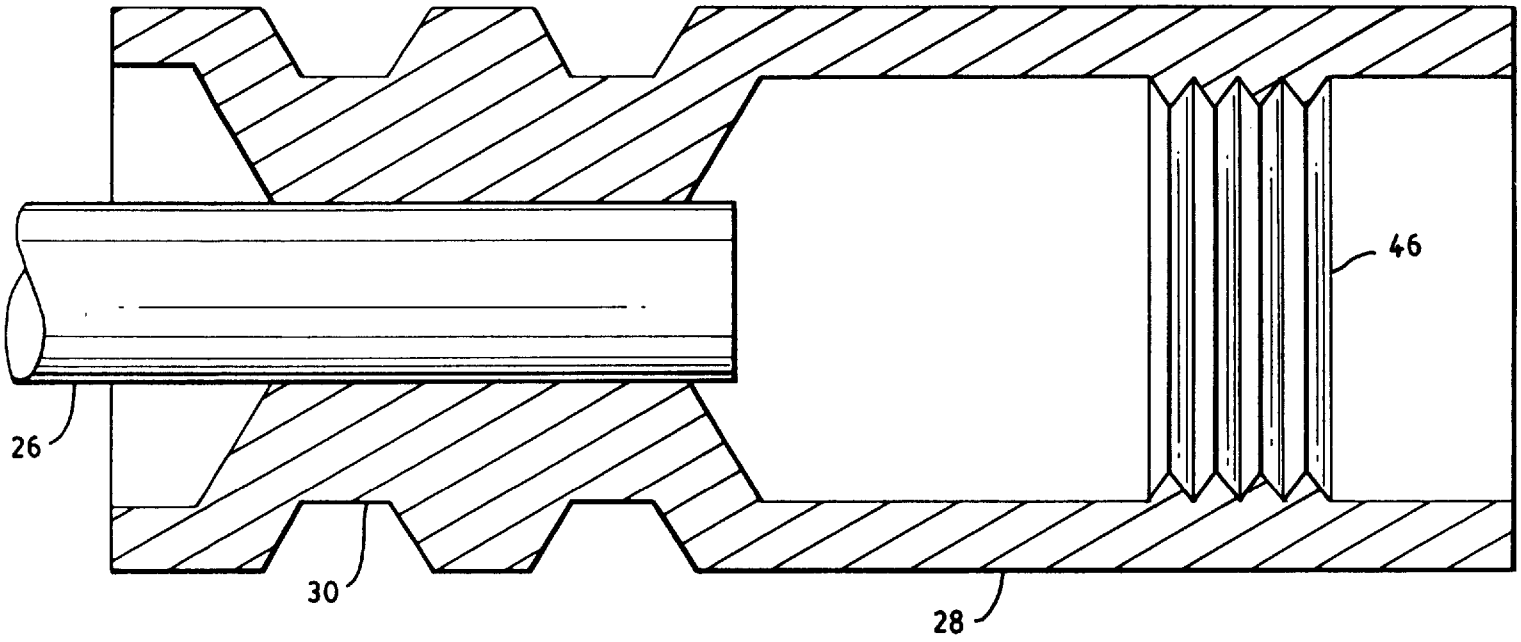
FIG. 4 shows a cross sectional view of an alternative embodiment of an internally ringed electrode.

FIG. 4 shows a cross sectional view of an alternative embodiment of an internally ringed electrode. Similarly, the internal edge, need not be a thread, but may be one or more rings 46.

Figure 5:
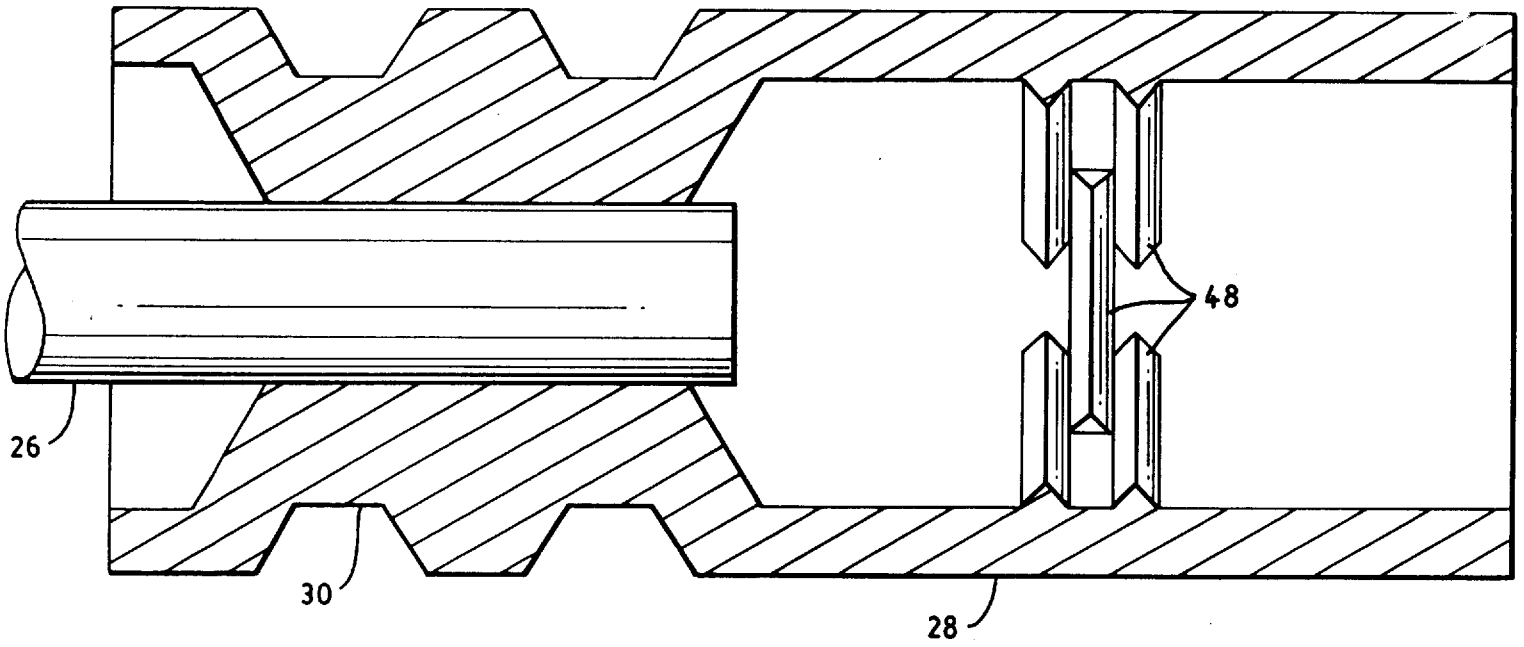
FIG. 5 shows a cross sectional view of an alternative embodiment of an internally gap ringed electrode.

FIG. 5 shows a cross sectional view of an alternative embodiment of an internally gap ringed electrode. The rings need not be continuous, but their axial projection should evenly extend around the inside surface of the electrode can. The gapped rings 48 provide an even supply of electrons for hollow cathode functioning of the electrode can. The alternative structures shown in FIGS. 3, 4, and 5 are understood to be more difficult to fabricate, and are believed to provide lower performance. These forms are then less useful, than the more easily fabricated threaded electrode can.

Figure 6:
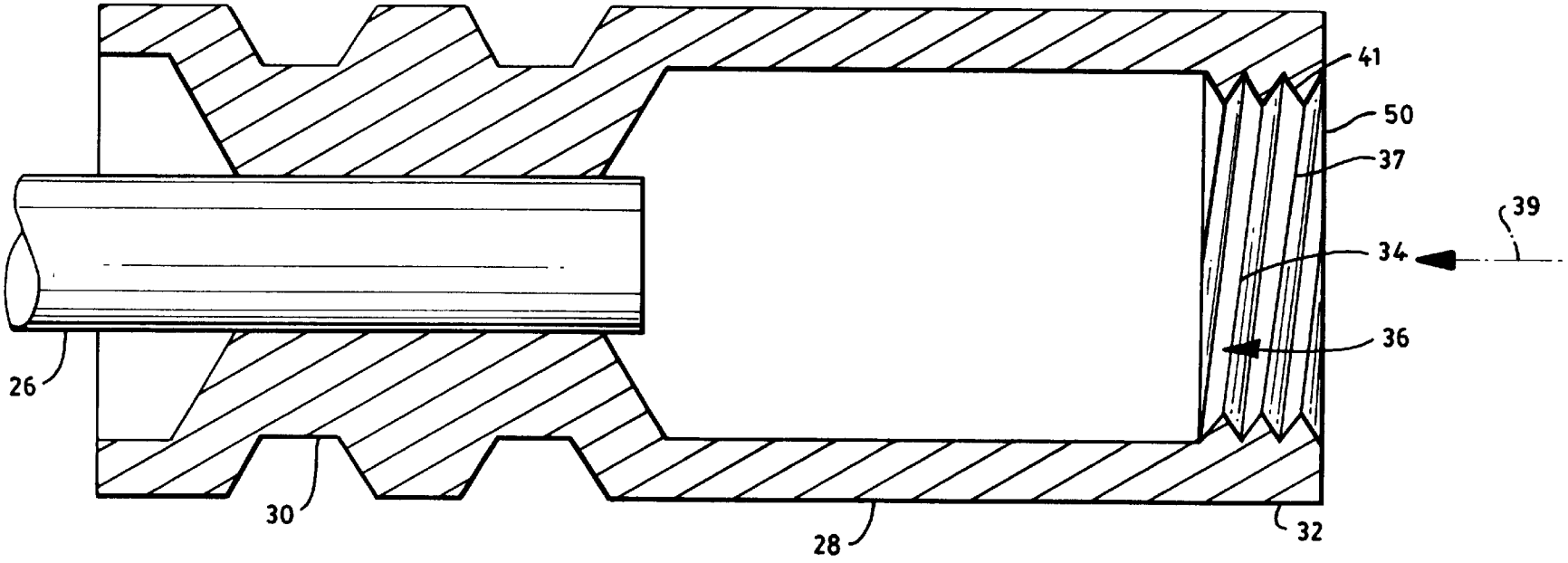
FIG. 6 shows a cross sectional view of an alternative embodiment of an internally ringed electrode.

FIG. 6 shows a cross sectional view of an alternative embodiment of an internally ringed electrode. The preferred embodiment is to form only a minimum threading 50 near or adjacent the opening of the electrode can. One full turn is believed to show results, and two turns would be better. It has been found that only a few turns of a threading, for example only 3 or 4 turns near opening of the can, appears to gain most of the desirable results. Using the least number of turns, minimizes manufacturing cost and time.

The preferred lamp 10 is formed with a similarly formed second electrode 38. The second electrode 38 has a similar or the same structure, and material as the first electrode 22. The envelope 12 seals in the fill material 40 which may be a gas, or gas and vaporizable material fill such one of those generally known in the art. In particular, a rare gas fill such as helium, xenon, argon, krypton, neon and combinations thereof may be used. Other gases, such as nitrogen, carbon monoxide and others known in the art may be used given the particular chosen lamp chemistry. The fill may include mercury or other material to aide in the lamp starting, to buffer the reaction, or to change the spectrum of the light radiation. The variety of fill gases and related materials is extensive and generally known in the art. The preferred fill material for a vehicle lamp is neon at a pressure of from 50 to 150 Torr, and not including mercury, but fill pressures are known to vary form a few torr to many atmospheres, depending on a variety of considerations.

The lamp may additionally include a fluorescent coating 42. If the discharge spectrum is adequately determined by emission from the fill materials, then no fluorescent coating may be necessary. On the other hand, where an even, diffuse light is useful, a phosphor coating 42 may be applied to the inside of the envelope 12. The choice of the particular phosphor coating is felt to be a matter of design choice. In the preferred neon vehicle stop lamp, the Applicants prefer no phosphor, thereby yielding a red stop lamp. The fill may be made out of fluorescent material, such as one of the many phosphor coatings used in fluorescent lamp making to have the general form of a thin coating on the inside surface of the envelope 12. The envelope 12 may be coated on the inside surface with the fluorescent coating 42.

In a working example, some of the dimensions were approximately as follows: The tubular envelope was made of 1724 hard glass, and had a tubular wall with an overall length of 50 centimeters, an inside diameter of 3.0 millimeters, a wall thickness of 1.0 millimeters, and an outside diameter of 5.0. The electrodes were made of molybdenum shafts supporting crimped on tantalum cups. The molybdenum rod had a diameter of 0.508 millimeter (0.020 inch). The exterior end of the molybdenum rod was butt welded to a thicker (about 1.0 millimeter) outer rod made of nickel coated steel. The inner end of the outer rod extended into the glass of the sealed tube about 2 or 3 millimeters. The thicker outer rod is more able to endure abusive coupling, than the thinner inner electrode support rod.

The electrode can was made of tantalum tube with one end with an internal thread machined on the interior wall at one end. (There is now some evidence that niobium tubes work equally well and may be less expensive, but study is incomplete.) The tantalum tube had an outside diameter of 1.828 millimeters (0.072 inches), an inside diameter of 1.32 millimeters (0.052 inches). The threading had a peak to valley height of 0.0889 millimeters (0.0035 inches) and extended for about one third of the length of the tube. It has been found that only a few turns of the threading, for example 3 or 4, are sufficient to create the effect, and that the can need not be threaded all the way to the base. The machined tube was then slipped over a molybdenum lead having a diameter of 0.762 millimeters (0.030 inches). The tube was then crimped in the region of the inserted lead to thereby bind the tube to the lead. No getter or emitter was applied to the tube cavity. It has been found that where the tube and lead are not sealed around the lead, that a small electron leakage occurs through the back end of the electrode. This leakage can draw off some or all of the discharge thereby distorting or mispositioning the arc. A good seal to the lead should then be made. A similar electrode was formed on a second lead, and the two electrodes were enclosed in the lamp. In particular a gas fill of a rare gas and perhaps mercury or other material, and had a pressure of from 50 to 150 torr. The fluorescent coating was made of phosphor material, such as one of the many phosphor coatings used in fluorescent lamp making, and had a thickness of approximately 20 microns.

Operation of the lamp was then investigated. The starting characteristics were determined by measuring the number of oscillatory periods that occur before complete ignition of the gas discharge. The ballast used for these measurements operated at a frequency of approximately 50 kilohertz with a maximum voltage from peak-to-peak of 11,000 volts. Based on a sample of over twenty lamps, the threaded tantalum cup electrode on average required approximately 4 cycles of the driving frequency with a variation of only one cycle to start. In a similar fashion, the Applicant's best alternative electrode was tested. This electrode was constructed as a straight can type electrode with 8488 getter internal coating. The can electrode showed a wide variation in starting cycles extending as high as 8 or more cycles. In some instances, the can and getter type electrode failed to initiate an arc condition within an acceptably safe time, causing the ballast's no fault safety circuit to time out, thereby shutting down the lamp.

The narrow starting variation with the threaded tantalum cups is believed to be attributable to the improved ignition behavior and the enhancement of the hollow cathode effect. The sharp ridges formed by the threads allows a uniform region of high electrical potential to exist, which promotes the formation of secondary electrons during the early development phase of the discharge. In general, the required maximum voltage for ignition has not been reduced by the use of the threaded tantalum cup. The improvement is in substantially improving the reliability of the starting. Improved starting affects the ballast in terms of the circuitry complexity required to guarantee starting within a fixed time.

The threaded tantalum cup has been testing for prolonged periods of operation, beyond 2,000 hours. The starting characteristic has remained essentially unchanged and the maintenance of the lamp was also unaffected.

The arc lamp ignition process for a low pressure discharge involves several steps. The initial step, which is mandatory, is that an electron be liberated either from a material surface, such as the electrode, or from the gas. The first mechanism, referred to as field emission, requires an external applied electrical field which is usually supplied by the open circuit voltage of the ballast. In the neon lamp, the voltage requirement to induce field emission is too great, so no field emission is used. The second electron liberation mechanism, is referred to as ionization, and can result from the ambient noise in the environment, for example cosmic rays or low levels of surrounding visible light. Neon lamps are known to be prone to the "dark" effect where the starting can be much harder in a very dark room.

The development of the threaded electrode was to effect the formation of the discharge after the production of the initial electron or ionization. The formation of the hollow cathode is that ionization tends to occur at regions of highest electrical field gradient, such as at points, or ridges that are formed by the thread. The value of a thread of a point is that as the ionization occurs the point at which electrons are freed is bombarded by the corresponding ions, i.e. positively charged neon atoms. This flux of charged particles increases the local temperature of the metal to the point that erosion or sputtering can occur. A thread forming a continuous ridge spreads the ionization out and reduces the local heating. The threaded cup cathode also acts as a hollow cathode device. The inside thread increases collisions inside the cup accelerating the discharge formation.

The performance benefit of the threaded electrode is observed not in a reduced starting voltage, which is fixed, but rather in the increased reliability of converting the initial ionization to the full discharge state, and in the reduced deterioration of the lamp through sputtered getter (emitter) material. The hollow cathode with threads, improves the ionization amplification, referred to as the Townsend Avalanche. A test was run with neon lamps (Ford Explorer stop lamps) all manufactured on the same equipment at the same time. A set of control lamps (A group) were manufactured with the standard nickel 8488 getter cups. A set of tantalum threaded cup lamps (B group) were then manufactured without a getter. Finally, a second set of control lamps (C group) were manufactured, again with the standard nickel 8488 getter cups. Over 100 lamps were made; 47 controls (A group and C group), and 77 with tantalum threaded cup electrodes (B group). All the lamps were processed the same way and were subjected to standard quality assurance testing. A primary lamp test, called the "eight volt light up," involves turning the lamp on many times with a standard ballast operated with only 8 volts for input. Under this condition the ballast generates a minimum open circuit voltage that is just sufficient to light good lamps, but not light poor quality lamps. The lamps that fail are reported as "no starts." This is a fairly severe test chosen to address vehicle safety expectations. No starts are normally scraped, and so this amounts to a costly waste. The A control group was tested first, and had 37.5% (9 of 24) no starts. The B group of tantalum threaded cup group was then tested, and found to have only 2.6% (2 of 77) no starts. The C control group was finally tested, and had 26.1% (6 of 23) no starts.

Another comparison was made between similar lamps with tantalum thread cup electrodes and with nickel cups with emitter filled electrodes. The first start voltage was tested. It was found that the percentage of lamps in the two lamp groups started approximately the same in the 0 to 1500 volt lamp voltage range. More of the threaded cup lamps started in the 1500 to 3000 volt range. While relatively more of the nickel cup electrode lamps required 3000 or more volts to start. The fact that the threaded electrodes worked as well as an electrode with an emitter material was surprising and of itself beneficial. With no emitter material to sputter, the threaded cup lamp walls will remain cleaner longer. The fact that the threaded cups lamps had fewer high voltage starters, means a less complex or robust (expensive) ballast is required to operate the lamp. The fact that the threaded cup electrodes had fewer high voltage starters, means they have a more reliably quick start up, which is relevant in a vehicle stop lamp. From a manufacturing point of view this improvement in starting reliability is quite important and leads to a substantial yield improvement. Additionally, the relatively more costly ballast can be simplified so as to ignite the lamp reliably in a narrow region, and not over a much broader range.

The improved lamp starting with the threaded tantalum cups is believed to be attributable to the improved arc ignition behavior and the enhancement of the hollow cathode effect. The sharp ridges formed by the threads allows a uniform region of high electrical potential to exist and promote the formation of secondary electrons during the early development phase of the discharge. It has been found that with the threaded electrode, the initial arc tended to attach to the front edge of the electrode, and then follow (walk) the thread into the electrode can, thus assuring a well located arc during the initial light up, and thereafter. Arc shifting, spread, and jitter were substantially reduced or eliminated. While there have been shown and described what are at present considered to be the preferred embodiments of the invention, it will be apparent to those skilled in the art that various changes and modifications can be made herein without departing from the scope of the invention defined by the appended claims.

What is claimed is:

1. An electric lamp comprising:

a) a light transmissive envelope defining an enclosed volume, b) a first input lead sealed to and extending through the envelope with an interior end of the first lead located in the enclosed volume, c) an electrode can attached to the interior end of the lead, the electrode can having a wall with an interior side defining an interior can cavity, and defining an opening of the can cavity at an end of the can away from the lead, the interior side further having a multiplicity of radially inward extending points, forming a radially constant distribution of points around the defined opening;

d) a second input lead sealed to and extending through the envelope with an interior end of the second lead located in the enclosed volume, e) a second electrode coupled to the interior end of the second lead, and f) a fill material enclosed in the enclosed volume excitable to light emission by the application of sufficient electric voltage and current between the first electrode and the second electrode.

2. An electric lamp comprising:

a) a light transmissive envelope defining an enclosed volume, b) a first input lead sealed to and extending through the envelope with an interior end of the first lead located in the enclosed volume, c) an electrode can attached to the interior end of the lead, the electrode can having a wall with an interior side defining an interior can cavity, and defining an opening of the can cavity at an end of the can away from the lead, the interior side further having at least one edge extended radially inward, forming an interior edge around at least a portion of the defined opening;

d) a second input lead sealed to and extending through the envelope with an interior end of the second lead located in the enclosed volume, e) a second electrode coupled to the interior end of the second lead, and f) a fill material enclosed in the enclosed volume excitable to light emission by the application of sufficient electric voltage and current between the first electrode and the second electrode.

3. The electric lamp in claim 2, wherein the interior wall is positioned symmetrically around an axis extending through the can.

4. The electric lamp in claim 3, wherein a plurality of edge segments in combination encircle the axis.

5. The electric lamp in claim 3, wherein the can is cylindrical.

6. The electric lamp in claim 5, wherein the edge encircles the axis.

7. The electric lamp in claim 6, wherein the edge is a circular band.

8. The electric lamp in claim 6, wherein the edge is a threading of at least one turn.

9. The electric lamp in claim 8, wherein the threading has more than two full turns.

10. The electric lamp in claim 2, wherein the edge has approximately a constant offset from the axis.

11. The electric lamp in claim 2, wherein the edge includes a corner, the vertex of which faces the interior of the can.

12. The electric lamp in claim 2, wherein the can is sealed to the lead, leaving no passages through the can interior to the rearward extending lead.

13. The electric lamp in claim 2, wherein the interior wall of the can is exposed, and has no emitter coating.

14. A threaded electrode comprising:

a) an electrically conductive lead having an axial elongation terminating at a lead end, b) an electrically conductive can, mechanically supported by, and electrically coupled to the lead, the can having a support end, an interior can wall defining an interior volume, an open can end exposing the interior volume, an axis extending from the support end through the interior volume to the open end, the can positioned about and sealed to the lead end to substantially enclose the lead end in the interior volume, the interior can wall further having at least one edge extended radially inward, forming an interior edge around at least a portion of the defined opening.

15. The electrode in claim 14, wherein the interior wall is positioned symmetrically around the axis extending through the can.

16. The electrode in claim 15, wherein a plurality of edge segments in combination encircle the axis.

17. The electrode in claim 15, wherein the can is cylindrical.

18. The electrode in claim 14, wherein the edge encircles the axis.

19. The electrode in claim 18, wherein the edge is a circular band.

20. The electrode in claim 19, wherein the edge is a threading of at least one full turn.

21. The electrode in claim 20, wherein the threading has more than two full turns.

22. The electrode in claim 14, wherein the edge has approximately a constant offset from the axis.

23. The electrode in claim 14, wherein the edge includes a corner, the vertex of which faces the interior of the can.

24. The electrode in claim 14, wherein the can is sealed to the lead, leaving no passages through the can interior to the rearward extending lead.

* * * * *